United States Patent [19]

Kirkley et al.

[11] 4,451,871

[45] May 29, 1984

[54] SAFETY LIGHT OR THE LIKE WITH HIGH CURRENT DRIVE

[75] Inventors: J. Darrell Kirkley; Joe C. Weaver, both of Dallas, Tex.

[73] Assignee: Jog-O-Lite, Inc., Dallas, Tex.

[21] Appl. No.: 428,113

[22] Filed: Sep. 29, 1982

[51] Int. Cl.[3] ..... F21L 7/00

[52] U.S. Cl. ..... 362/186; 200/60; 362/103; 362/191; 362/200; 362/800; 362/802

[58] Field of Search ..... 362/103, 186, 200, 191, 362/800, 802; 200/60

[56] References Cited

U.S. PATENT DOCUMENTS

| | | | |
|---|---|---|---|
| 2,854,563 | 9/1958 | Catching | 362/802 |
| 3,321,617 | 5/1967 | Santana | 362/191 |
| 4,296,459 | 10/1981 | DeLuca | 362/104 |
| 4,309,743 | 1/1982 | Martin | 362/104 |
| 4,319,309 | 3/1982 | Benoit | 362/200 |

*Primary Examiner*—Stephen J. Lechert, Jr.
*Attorney, Agent, or Firm*—Stephen S. Sadacca

[57] ABSTRACT

A relatively light weight, low cost compact safety light which may be worn or carried by athletes such as joggers, runners, cyclists, etc. is provided. The safety light is comprised of a light source coupleable to a battery power supply by a position sensitive switch which is sensitive to movement of the athlete and provides intermittent bursts of light which are highly visible to oncoming cars. In one embodiment, the light source is comprised of a light emitting diode coupled to one or more pen light batteries by a position sensitive switch such as a mercury switch. One or more lense members are provided to increase the visibility of the light generated by the light source. A first reflective means located within the safety light housing is utilized to reflect the light generated by the light source through the lense member while a second reflective means located on the outside of the housing provides additional reflectivity for the light generated by oncoming cars. The edges of the safety light housing are so angled or curved that the safety light can only rest on either its front or rear major surfaces, in which position the position sensitive switch is always off, thereby eliminating the need for any additional on/off switch. The light source may be operated from a battery source which provides current to the light source in excess of its maximum current rating to provide light of greater intensity than is normally producible from such light source. The position sensitive switch is so positioned within the housing that the light source goes on only intermittently when the safety light is being jiggled by the athlete in motion, and as a result the light source may be operated indefinitely in this over maximum rating condition without danger to the light source.

8 Claims, 4 Drawing Figures

SAFETY LIGHT OR THE LIKE WITH HIGH CURRENT DRIVE

This invention relates to safety lights for persons walking and athletes such as joggers, runners, cyclists, etc., and more particularly to such safety light which provides a relatively strong intermittent light beam easily recognizable by vehicular traffic.

BACKGROUND OF THE INVENTION

Various athlete safety lights have been suggested in the prior art to enable joggers, runners, cyclists, etc., to be recognized by oncoming vehicular traffic. One such safety light is rather bulky, utilizing a belt to be worn by the athlete containing a battery pack. Another such safety light utilizes a complex and rather expensive transistorized oscillator circuit to provide intermittent flashing of a lamp.

It would be desirable to provide a safety light which may be worn by athletes, particulary at night, which is relatively simple, light weight, low cost, small, and yet highly visible to oncoming vehicular traffic.

It is therefore an object of the present invention to provide an improved safety light which may be worn or carried by walkers and athletes such as joggers, runners, cyclists and the like.

It is another object of the invention to provide such safety light with higher visibility than heretofor available.

It is yet another object of the invention to provide a safety light which is operable on relatively low cost, light weight batteries for an extended period of time.

Still another object of the invention is to provide a relatively low cost safety light which does not require an on/off switch or other special switching means to prevent illumination when the safety light is not being worn.

Yet another object of the invention is to provide a saftey light which is capable of generating light of greater intensity than previously known for a given battery source power supply.

It is still a further object of the invention to provide a safety light which is capable of both generating light and also reflecting light from oncoming vehicles.

BRIEF DESCRIPTION OF THE INVENTION

These and other objects are accomplished in accordance with the present invention in which a relatively light weight, low cost compact safety light which may be worn or carried by persons walking and athletes such as joggers, runners, cyclists, etc. is provided. The safety light is comprised of a light source coupleable to a battery power supply by a position sensitive switch which is sensitive to movement of the athlete and provides intermittent bursts of light which are highly visible to oncoming cars. In one preferred embodiment, the light source is comprised of a light emmitting diode coupled to one or more pen light batteries by a position sensitive switch such as a mercury switch. In a further embodiment, one or more lens members are provided to increase the visibility of the light generated by the light source. In yet another embodiment, a first reflective means located within the safety light housing is utilized to reflect the light generated by the light source through the lens member while a second reflective means located on the outside of the housing provides additional reflectivity for the light generated by oncoming cars. In still a further embodiment, the edges of the safety light housing are so angled or curved that the safety light can only rest on either its front or rear major surface, in which position the position sensitive switch is always off, thereby eliminating the need for any additional on/off switch. In yet a further embodiment, the light source is operated from a battery source which provides current to the light source in excess of its maximum current rating to provide light of greater intensity than is normally producible from such light source. Because the position sensitive switch is so positioned within the housing that the light source goes on only intermittently when the safety light is being jiggled by the athlete in motion, the light source may be operated indefinitely in this over-maximum rating condition without danger to the light source.

PRIOR ART STATEMENT

Wood, U.S. Pat. No. 3,384,740 teaches a piece of jewlery such as an earing which provides intermittent light from a sub miniature filament-type bulb connected to a battery by means of a special on/off switch having a lever which, when turned to the on position may be contacted by a dangling filament or wire to complete the circuit, thereby providing intermittent bursts of light when the wearer causes movement of the dangling filament. Wood does not show or suggest a safety light for athletes having any of the features embodied in the present invention. In particular, Wood does not show or suggest either alone or in combination, a light emitting diode light source, a light source which is operated by a battery power supply providing current which exceeds the maximum rating of the light source, amplifying lenses, dual reflectors or a housing which is so shaped that an on/off switch is not required to prevent illumination when the light is not being worn.

Cukale, U.S. Pat. No. 3,840,853 teaches a safety blinker belt for a cyclist having a battery supply with on/off switch located in a compartment attached to the belt and an incendesent bulb and mercury switch in each of two other compartments of the belt. Cukale does not show or suggest a compact and highly visible safety light which may be comfortably worn by joggers and runners as well as cyclists having any of the features embodied in the present invention. In particular, Cukale does not show or suggest either alone or in combination, a light emitting diode light source, a light source which is operated by a battery power supply providing current which exceeds the maximum rating of the light source, amplifying lenses, dual reflectors to enhance visibility by oncoming vehicular traffic or a housing which is so shaped that an on/off switch is not required.

Kelly, U.S. Pat. No. 4,047,150 teaches a bicycle safety flasher with optional mounting means which enables it to be worn by a person. The safety flasher incorporates a relatively complex and expensive dual transistor circuit which is connected to a battery power source by means of an on/off switch and drives an incandescent bulb. Kelley does not show or suggest any of the novel features of the present invention, and in particular, does not show either alone or in combination, a position sensor, a light emitting diode light source, a battery supply which provides current to the light source in excess of the light source's maximum current rating, amplifying lenses, dual reflectors, or a housing and circuit arrangement which permits elimination of an on/off switch.

BRIEF DESCRIPTION OF THE DRAWINGS

Still further objects and advantages of the present invention will be evident from the detailed description and claims when read in conjunction with the accompanying drawings wherein:

DETAILED DESCRIPTION OF A PREFERRED EMBODIMENT

Figure 1:
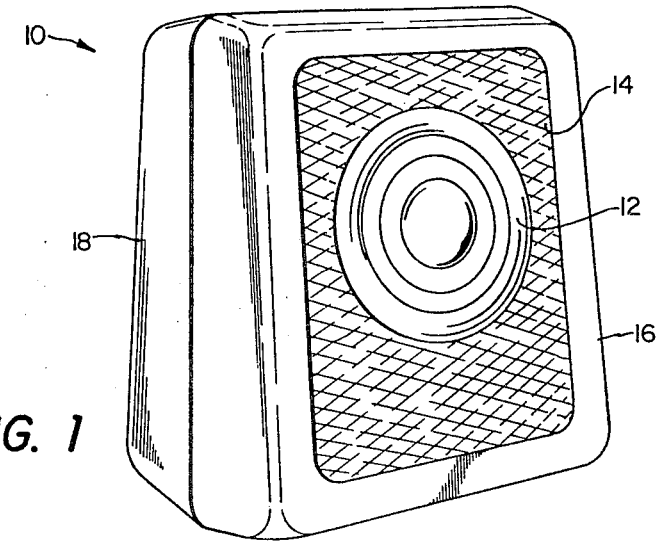
FIG. 1 is a perspective view of an athlete safety light or the like embodying the present invention.

Referring now to the drawings, and in particular to FIG. 1, a safety light 10 which may be worn or carried by a person walking and an athlete such as a jogger, runner, cyclist, etc. embodying the present invention is shown. Safety light 10 is comprised of a front housing member 16 and rear housing member 18 seperably fastened together by means of screws or the like. Front housing member 16 includes a reflector member 14 mounted thereon for reflecting externally generated light such as that which may be received from the headlights of an oncoming automobile or other vechicle and a lens member 12 which is preferably adopted to selectively direct or amplify the beam of light generated by the internal light source. Reflector member 4 may be a red, yellow, white, silver, etc. plastic material, for example, having cross cuts located on one surface thereof, similar to the type of reflectors employed on bicycles and the tail lights of automobiles.

Figure 2:
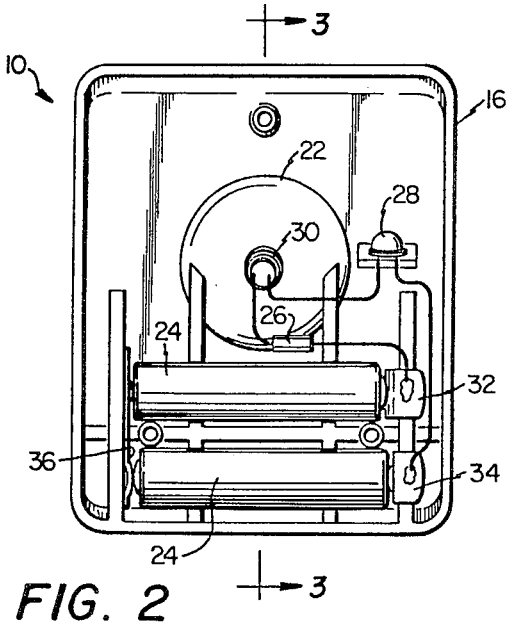
FIG. 2 is a rear elevational view of the safety light of FIG. 1 with the back cover removed exposing the circuit elements and battery compartment.
Figure 3:
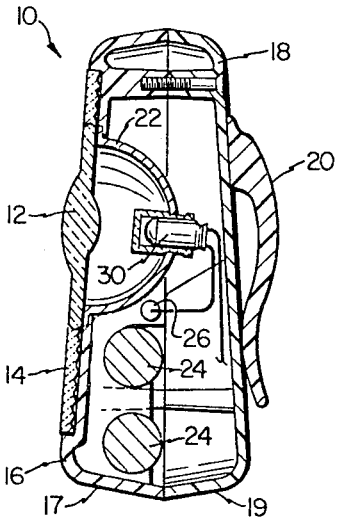
FIG. 3 is a cross-sectional view of the safety light of FIG. 1 further showing the placement of the circuit elements; and, FIG. 4 is a circuit diagram showing the connection of the electrical components of the embodiment of FIG. 1.

Referring to FIGS. 2 and 3, contained within housing 10 is a light source which in the present embodiment is a vey low current light emitting diode 30 coupled to a battery source of power 24 by means of a position sensor 28. The battery means 24 are contained within a battery holder which includes connectors 32, 34, and 36. A resistor 26 may be utilized to limit current flow and protect the light emitting diode if desired. It should be noted, however, and in accordance with an embodiment of the present invention, light emitting diode 30 is operated by applying current from battery means 24 which greatly exceeds the current rating of light emitting diode 30. Unless the current rating of light emitting diode 30 is grossly exceeded, for example more than five times the maximum current rating, it has been found that light emitting diode 30 will operate indefinately and yet generate light bursts of greater intensity than otherwise acheivable. This is possible because light emitting diode 30 is always being operated intermittently by means of position sensor 28, and is not permitted to remain on countinuously for an extended period of time. In a preferred embodiment, position sensor 28 is a mercury type switch.

Reflector member 22 may include a second amplifying lens into which light emitting diode 30 is inserted to further amplify the light generated by light emitting diode 30 as shown on FIG. 3.

Referring to FIG. 3, the edges of housing members 16 and 18 are slanted as can clearly be seen by viewing edges 17 and 19, respectively located on the bottom edge of the housing or case. This prevents the case from being able to rest or stand on any of its edge surfaces and hence, must either rest on its front or rear major surface. Alternately, the edge surface or surfaces may be sufficiently curved to prevent the case from resting on any of its edge surfaces. Position sensor 28 prevents light emitting diode 30 from being on while the case is resting on either of these major surfaces; hence, no on/off switch is required. Furthermore, this unique shape and position sensor arrangement prevents light emitting diode 30 from being accidentally damaged when operated in the high current mode discussed above as would be the case if such high current were to be applied in a continuous fashion.

A clip member 20 is provided so that safety light 10 may conveniently be clipped to almost any article of clothing and is light weight and compact enough to be worn by walkers, joggers and runners for complete nighttime safety. It should also be noted that the safety light may be clipped to the collar of a dog or other pet to make the pet visible to oncoming vehicles at night.

Figure 4:
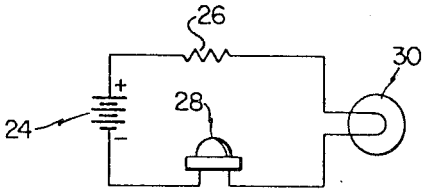

Referring to FIG. 4, a circuit diagram is illustrated showing position sensor 28 coupling light source 30 to a battery power supply 24. Again, although resistor 26 may be employed to limit current to light source 30, in most instances it is not necessary. As discussed above, the light source is preferrably a light emitting diode because of its low current drawing characteristics which permits the battery power supply to last for an extended period of time. The light emitting diodes may, for example, be Hewlett Packard HP 3850, HP 4555 HP 4658 light emitting diodes. The batteries which comprise the battery power supply are, for example, two series connected AAA penlight cells which are relatively low cost and light weight. The HP 3850 or HP 4555 light emitting diode may be operated directly from these cells without a resistor 26, even though the current produced from fresh cells of this type greatly exceeds the maximum current rating of such light emitting diodes. The position sensor may be implemented by any of the many commercially available mercury switches, but is preferrably a mercury switch containing a minimum amount of mercury to provide the greatest amount of intermittent operation, thereby extending the operational lifetime of the batteries.

Various embodiments of the present invention have now been described in detail. It is to be noted, however, that these descriptions of specific embodiments are merely illustrative of the principles underlying the inventive concept. It is contemplated that various modifications of the disclosed embodiments as well as other embodiments of the invention will, without departing from the spirit and scope of the invention, be apparent to persons skilled in the art.

We claim:

1. A safety light for athletes or the like to be recognized by oncoming vehicles comprising:

(a) a housing having a first lens member disposed therein and adapted to contain battery means;

(b) light generating means being contained within said housing for generating intermittened bursts of light which are visible exterior of said housing through said first lens member, said light generating means including a light source means having a predetermined maximum current rating and a position sensor means coupled in a series circuit with said battery means and said light source means, said position sensor means being positioned in said housing to normally provide an open circuit and to provide intermittent current from said battery means to said light source means only when said housing is jiggled, and (c) current control means in said series circuit with said light source and battery means, said current control means providing predetermined current flow from said battery means through said light source means which is in excess of said predetermined maximum current rating.

2. The safety light according to claim 1 wherein said current control means is a resistor.

3. The safety light according to claim 1 wherein said current control means is a conductor which permits the maximum current flow to be controlled by the internal resistance of the battery means.

4. The safety light according to claim 1 including a lens member for directing the light generated by said light source means, thereby increasing the visibility of said light.

5. A safety light according to claim 4 wherein said light generating means includes a light emitting diode means.

6. The safety light according to claim 5 including a second lens member disposed over said light emitting diode means for spreading the light beam generated by said light emitting diode means, thereby further increasing the visibility of said light source means through said first lens member.

7. The safety light according to claim 5 wherein the current applied to said light emitting diode means is at least two times the maximum current rating of said light emitting diode means.

8. The safety light according to claim 1 wherein said position sensor means is comprised of a mercury switch.

* * * * *